United States Patent [19]

Johns et al.

[11] Patent Number: 4,678,719

[45] Date of Patent: Jul. 7, 1987

[54] METHOD AND APPARATUS FOR CONTINUOUS CASTING OF CRYSTALLINE STRIP

[75] Inventors: Robert H. Johns; John D. Nauman, both of Natrona Heights, Pa.

[73] Assignee: Allegheny Ludlum Corporation, Pittsburgh, Pa.

[21] Appl. No.: 876,308

[22] Filed: Jun. 18, 1986

Related U.S. Application Data

[63] Continuation of Ser. No. 560,373, Sep. 13, 1984, abandoned.

[51] Int. Cl.[4] ..... B22D 11/06; B22D 11/10

[52] U.S. Cl. ..... 428/593; 164/463; 164/423; 428/606

[58] Field of Search ..... 164/423, 463; 428/593, 428/606

[56] References Cited

U.S. PATENT DOCUMENTS

| | | | |
|---|---|---|---|
| 112,054 | 2/1871 | Lang . | |
| 905,758 | 12/1908 | Strange et al. . | |
| 993,904 | 5/1911 | Strange . | |
| 3,381,739 | 5/1968 | Hart | 164/64 |
| 3,522,836 | 8/1970 | King | 164/67 |
| 4,221,257 | 9/1980 | Narasimhan | 164/87 |
| 4,274,473 | 6/1981 | Bedell et al. | 164/423 |
| 4,290,476 | 9/1981 | Smith et al. | 164/423 |
| 4,399,860 | 8/1983 | Johns | 164/463 X |

FOREIGN PATENT DOCUMENTS

| | | | |
|---|---|---|---|
| 147912 | 8/1984 | European Pat. Off. . | |
| 24320 | 5/1910 | United Kingdom . | |
| 1354771 | 5/1974 | United Kingdom | 164/479 |

*Primary Examiner*—Kuang Y. Lin
*Attorney, Agent, or Firm*—Patrick J. Viccaro

[57] ABSTRACT

A method is provided for directly casting molten metal from of the exit end of a casting vessel onto a moving casting surface to form a continuous strip of crystalline metal. The surface tension of the molten metal flowing from the exit forms the top, edge and bottom surfaces of the strip being cast to provide good strip surface quality, edges and structure. An apparatus is also provided including a casting vessel having a molten metal receiving end and an exit end from which a fully developed uniform flow of molten metal leaves through a U-shaped structure onto a moving casting surface. A direct cast strip product is also provided.

29 Claims, 11 Drawing Figures

METHOD AND APPARATUS FOR CONTINUOUS CASTING OF CRYSTALLINE STRIP

This is a continuation of application Ser. No. 650,373 filed Sept. 13, 1984, now abandoned.

BACKGROUND OF THE INVENTION

This invention relates to method and apparatus for direct casting of metal alloys from molten metal to continuous strip. More particularly, it relates to feeding molten metal through an open casting vessel outlet to solidify continuous strip of desired thickness on a moving casting surface.

In conventional production of metal strip, such methods may include the steps of casting the molten metal into an ingot or billet or slab form, then typically includes one or more stages of hot rolling and cold rolling, as well as pickling and annealing at any of various stages of the process in order to produce the desired strip thickness and quality. The cost of producing continuous strip, particularly in as cast gauges ranging from 0.010 inch to 0.100 inch (0.0254 to 0.254 cm) could be reduced by eliminating some of the processing steps of conventional methods. The as-cast strip could be processed conventionally, by cold rolling, pickling and annealing to final gauges of 0.002–0.040 inch.

There are known a wide variety of methods and apparatus for the production of directly cast strip. Typical of such methods are those which include spraying molten metal through a metering orifice across a gap to a rapidly moving quenching surface such as a wheel or continuous belt; methods which partially submerge a rotating quenching surface into a pool of molten metal; methods which use horizontal link belts as quenching substrates upon which molten metal flows for solidification; and methods of casting with twin casting rolls having a pool of molten metal therebetween.

Direct casting of metals through an orifice has long been attempted for the commercial production of strip with good quality and structure. U.S. Pat. No. 112,054 dated Feb. 21, 1871 discloses a method of manufacturing flat solder wire from molten metal forced through an orifice and onto a rotating casting surface. Similarly, U.S. Pat. No. 905,758, issued Dec. 1, 1908, discloses a method of drawing molten metal out of an outlet at the lower end of a vessel and onto a casting surface. British Pat. 24,320, dated Oct. 24, 1910, discloses a method of producing sheet or strip from molten metal flowing through a tube channel having at least one side in contact with the moving casting surface. Representative of a more recent system is U.S. Pat. No. 3,522,836—King, issued Aug. 4, 1970, which discloses a method of maintaining a convex meniscus projecting from a nozzle and moving a surface past the nozzle orifice outlet to continuously draw off material and solidify as a continuous product. The molten material is maintained in static equilibrium at the outlet and gravitationally maintained in continuous contact with the moving surface. U.S. Pat. No. 4,221,257—Narasimhan, issued Sept. 9, 1980, relates to a method of forcing molten metal under pressure through a slotted nozzle onto the surface of a moving chill body.

The orifice-type casting systems are generally restricted to light gauge materials as cast usually on the order of less than about 0.010 inch (0.0254 cm) in thickness. Such systems appear to be gauge-limited for the moving quenching surface appears to be limited in the material which it can solidify and carry away as it is delivered from the nozzle orifice. Such systems behave as a molten metal pump and transfer excess molten metal from the orifice to the quenching surface in a molten state with more heat than can be extracted to provide a suitable strip. By reducing the delivery rate of the metal and/or by increasing the velocity of the quenching surface, such a condition can be overcome, however, a reduction in gauge will result.

When crystalline strip is attempted to be produced at the high speeds associated with the orifice-type casting systems, poorer quality usually results. As molten metal is sprayed upon a high-speed quenching surface or is flowed out full width on a slower-moving horizontal belt, it rapidly moves away from the source of the supply in a still partially molten state. It is this condition that leads to the deterioration in quality, for as the strip rapidly solidifies from the quenching surface side of the strip, shrinkage occurs which can only be moderated by a fresh supply of molten metal. Without such a fresh supply of molten metal, cracks quickly develop within the structure of the strip and greatly reduce its physical properties. Attempts have been made to improve the nozzle geometry to overcome the problems associated with orifice-type casting as shown in U.S. Pat. Nos. 4,274,473, issued June 23, 1981 and 4,290,476, issued Sept. 22, 1981. A disadvantage of the orifice-type casting is that the orifice meters out an amount of molten metal which, in effect, determines the gauge of the strip. Furthermore, relatively high pressure heads used in order to supply enough molten metal to the orifice and a relatively small standoff distance from the casting wheel for containment of the molten metal also limits the strip gauge.

Thicker strip can be produced on a single quenching surface such as by dipping a slowly rotating quenching wheel into a static supply of molten metal to permit the solidification of a much thicker strip. Molten metal solidifies on the surface of this wheel and continues to thicken at a predictable rate until it immerges from this bath of molten metal or it separates from the surface. The fresh supply of molten metal avoids the cracking generally associated with solidification of a finite layer such as in orifice-type casting. Furthermore, an extremely steep thermal gradient between this molten pool and the solidification front also leads directly to a more uniform internal structure and superior upper surface quality. A drawback from such a dip system comes from the difficulty of keeping molten metal from solidifying upon the edges of the slightly submerged quenching wheel and having a tendency to cast a channel-like structure. Furthermore, there is the added difficulty of insuring uniform contact between the solidifying strip and the surface of the quenching wheel as it enters the molten pool, and results in poor surface quality on the cast side of the strip. Such difficulties lead to spot variations in strip gauge, wherein lighter gauge sections are produced where intimate contact is reduced or lost.

Other direct casting processes have been proposed, but have not developed into commercial processes. For example, pouring of molten metal on the top of a moving casting wheel produces strip of nonuniform gauge, poor edges and unacceptable quality. U.S. Pat. No. 993,904, dated May 30, 1911, discloses an apparatus including a molten metal first vessel with a gravity discharge outlet opening into the lower part of a tray-like second vessel below the level of molten metal therein. The molten metal passes out of the second vessel through an overflow to deliver molten metal to a casting wheel. U.S. Pat. No. 3,381,739, issued May 7, 1968, discloses a method of forming sheet or strip material by flowing liquid about a surface which is wetted and bridging the distance to the moving casting surface on which it solidifies.

What is needed is a method useful in commercial production for direct casting strip having surface quality comparable to or better than conventionally-produced strip. The method and apparatus of direct casting should produce strip which is superior to orifice-type casting, as well as other known direct casting processes including dip-cast systems, horizontal link belt quenching systems, and twin casting rolls. It is an objective that the method and apparatus overcome the disadvantages of known direct casting methods. Furthermore, what is needed is a method and apparatus to permit the direct casting of relatively thick strip on the order of greater than 0.010 inch (0.0254 cm) and up to about 0.100 inch (0.254 cm) or more. It is desirable that the factors contributing to shrinking and cracking of direct cast strip be minimized or eliminated in order to provide improved surface quality and structure of strip. Furthermore, a method and apparatus is desirable which is suitable for commercial production of strip at reduced cost and to facilitate production of new alloys. The direct cast strip should have good surface quality, edges and structure and properties at least as good as conventionally cast strip.

SUMMARY OF THE INVENTION

In accordance with the present invention, a method is provided for directly casting molten metal to continuous strip of crystalline material. The method includes supplying molten metal to a casting vessel having a receiving end and exit end being adjacent a casting surface moving generally upwardly past the exit end. The molten metal is fed from the receiving end to the exit end to provide a pool of molten metal having a substantially uniform flow and free upper surface in the exit end. The molten metal flows from the exit end onto the casting surface such that across the width of the exit end of the casting vessel a substantially uniform flow of molten metal is presented to the casting surface. The surface tension of the flowing metal forms all the surfaces of the strip being cast. The top surface tension of the free surface of molten metal pool forms the top of the cast strip, and the surface tension of the molten metal leaving the sides of the exit end forms the edges of the cast strip. The surface tension of the molten metal leaving the bottom of the exit end maintains a meniscus between an inside surface of the bottom of the exit end and the casting surface to form the bottom of the cast strip. The depth of the molten metal in the exit end and distance between the vessel and casting surface are controlled to maintain the surface tension. The as-cast strip is removed from the casting surface.

An apparatus is also provided for directly casting molten metal to continuous strip of crystalline material comprising a movable casting surface, a casting vessel and a means for supplying molten metal to the casting vessel. The casting vessel has a receiving end, an exit end having a generally U-shaped structure adjacent the casting surface and having edges thereof substantially parallel thereto and an intermediate section to facilitate a substantially uniform flow of molten metal from the receiving end to the exit end. The U-shaped structure of the exit end has a bottom wall and diverging inside sidewall surfaces opening upwardly and having the width between the inside surfaces being about as wide as the strip to be cast. The exit end has a fixed width along the bottom wall between the inside surfaces and a uniform cross-sectional area over a length sufficient to provide a substantially uniform flow of molten metal from the exit end. The casting surface is movable generally upwardly past the exit end of the casting vessel at a distance of between 0.005 to 0.060 inch (0.013 to 0.152 cm) therefrom at a speed of 20 to 500 feet per minute.

A continuous direct cast strip product made in accordance with the present invention is also provided.

DETAILED DESCRIPTION OF THE PREFERRED EMBODIMENTS

Figure 1:
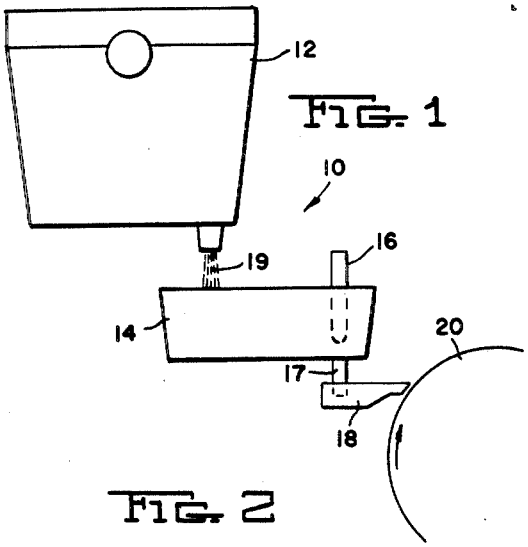
FIG. 1 is a schematic of a strip casting apparatus of the present invention.

FIG. 1 generally illustrates casting apparatus 10 including transfer vessel 12 and feed tundish 14 for supplying molten metal to casting vessel 18 for directly casting molten metal on a casting surface 20 to produce continuous product in strip or sheet form 15. Molten metal 19 is supplied from vessel 12 to tundish 14 to casting vessel 18 in a conventional manner. Stopper rod 16 or other suitable means may control the flow of molten metal to casting vessel 18 such as through spout 17. Casting vessel 18 is shown substantially horizontal having a receiving end and an exit end disposed adjacent to the casting surface 20.

The supply of molten metal 19 through the casting vessel 18 may be accomplished by any suitable conventional methods and apparatus of vessels, tundishes, or molten metal pumps, for example. Vessel 12 and feed tundish 14 may be of known design and should be suitable for supplying an adequate amount of molten metal to casting vessel 18 for strip generation at the quenching wheel.

Casting surface 20 may also be conventional and may take the form of a continuous belt, or a casting wheel. Preferably a casting wheel is used. The composition of the casting surface does not appear to be critical to the present invention, although some surfaces may provide better results than others. The method and apparatus of the present invention have been used with casting surfaces of copper, carbon steel and stainless steel. It is important that the casting surface be movable past the casting vessel at controlled speeds and be able to provide desired quenching rates to extract sufficient heat for solidifying the molten metal into strip form. The casting surface 20 is movable past casting vessel 18 at speeds which may range from 20 to 500 feet per minute, preferably 50 to 300 feet per minute (FPM), which is suitable for commercial production of crystalline material. The casting surface 20 should be sufficiently cool in order to provide a quenching of the molten metal to extract heat from the molten metal for solidification of strip of crystalline form. The quench rates provided by casting surface 20 of apparatus 10 are less than 10,000° C. per second and typically preferably less than 2000° C. per second.

Two important aspects of the casting surface are that it have a direction of movement generally upwardly past the exit end of vessel 18 and a free surface molten metal pool in exit end 26. The free surface of the molten metal pool in exit end 26 is essential to development of good top surface quality of the cast strip. By "free", it is meant that the top surface is unconfined by structure, i.e., not in contact with vessel structure and free to seek its own level between receiving section 22 and exit end 26. Generally, the path is oriented at an included angle $\theta$ from about 0° to 135° from the horizontal and in the direction of metal flow as measured between the direction of metal flow at the free surface of molten metal in the exit end and the direction of movement of the casting surface at the free surface in the exit end of casting vessel 18. For a casting wheel, the path of the casting surface is tangent to the surface at the exit end of vessel 18. Preferably, the angle is between 0° and 45° from the horizontal. For a casting wheel, preferably, the vessel is adjacent a position in an upper quadrant of the wheel when the free surface of molten metal is near the crown of the casting wheel, the angle is at about the 0° position.

Figure 2A:
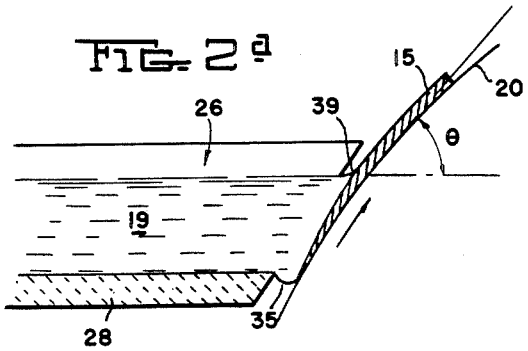
FIG. 2*a* is a detailed elevation view of FIG. 2.
Figure 2B:
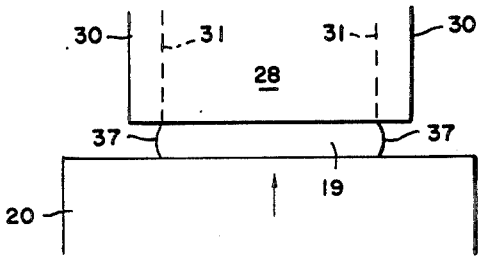
FIG. 2*b* is another detailed view of FIG. 2.
Figure 2:
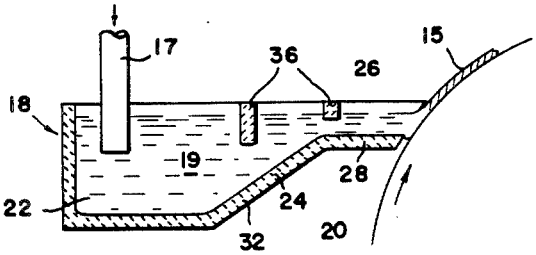
FIG. 2 is an elevated view in cross section of a casting vessel of the present invention.

Casting vessel 18 is essential to the method and apparatus 10 of the present invention and is better shown in FIG. 2 which is an elevation view of the vessel 18. Casting vessel 18 is disposed adjacent casting surface 20, preferably is substantially horizontal, and is composed of heat insulative and refractory material described below. This arrangement is necessary for providing the required uniform and fully-developed flow of molten metal to the casting surface 20. Vessel 18 includes a receiving end 22 at a rearward section and an exit end 26. Preferably, receiving end 22 and exit end 26 have substantially the same cross-sectional area or exit end 26 has a greater cross-sectional area as measured perpendicular to the direction of metal flow from the receiving end 22 to exit end 26. Receiving end 22 is shown deeper than exit end 26 which facilitates receiving molten metal 19 such as from supply spout 17 and for developing a flow of molten metal to exit end 26.

Figure 3A:
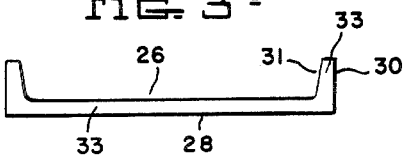
FIG. 3*a* is an end view of the casting vessel of FIG. 3.
Figure 3:
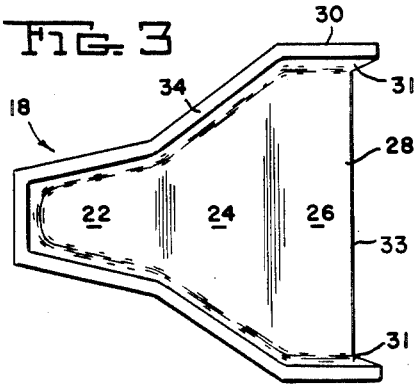
FIG. 3 is a top view of a casting vessel of FIG. 2.

Exit end 26 of vessel 18 has a generally U-shaped structure defined by a bottom wall portion 28 and sidewalls 30, as is shown in FIG. 3. Sidewalls 30 may have vertical inside wall inside surfaces 31, but preferably, the surfaces 31 of sidewalls 30 of the U-shaped structure diverge to open upwardly to facilitate metal flow. The slight taper tends to improve metal flow from exit end 26, but too great a taper may cause a loss of surface tension control and flooding of molten metal. A taper of less than 10° per side and preferably 1°–5° is provided.

Exit end 26 includes bottom wall 28 which has a generally planar inside portion having a length sufficient to provide a substantially uniform flow of molten metal from the exit. Preferably, the length of the planar wall portion as measured in the direction of metal flow is at least equal to the depth of molten metal pool to be contained in exit end 26. More preferably, the ratio of length to depth is at least 1:1 or greater. Exit end 26 preferably has fixed or uniform dimensions of width and height throughout the length of the planar inside surface of bottom wall 28 to define a uniform cross-sectional area in exit end 26. The width of the exit end 26 as measured between the inside surfaces 31 of sidewalls 30 along the free surface of molten metal pool is about as wide as the strip to be cast. Preferably, exit end 26 is positioned adjacent casting surface 20 with the ends or edges 33 of the sidewalls 30 and bottom wall 28 defining the U-shaped structure being substantially parallel to the casting surface.

To facilitate transition flow between receiving section 22 and exit end 26, an intermediate section 24 communicating between the receiving end 22 and the exit end 26 should be provided in order to have a substantially uniform flow at exit end 26. Preferably, intermediate section 24 maintains substantially uniform cross-sectional area throughout its length for receiving section 22 to exit end 26. Intermediate section 24 shown in FIG. 3 has a gradually increasing width from the receiving end 22 to exit end 26 and, as shown in FIG. 2, a gradually decreasing depth so as to maintain a substantially uniform cross-sectional area throughout it length. Intermediate section 24 may be provided with a tapered bottom wall 32 which gradually decreases the depth of the vessel 18 from the receiving end 22 to the exit end 26. Similarly, intermediate section 24 may have at least one sidewall 34 which fans outwardly in order to provide a gradually increasing width from the narrower receiving end 22 to the wider exit end 26. FIG. 2 is a top view of casting vessel 18 illustrating the widening of sidewall 34 of intermediate section 24.

FIG. 2 also illustrates that weirs or weir plates 36 may be used in casting vessel 18 such as in an intermediate section 24 or near where section 24 merges into exit end 26 in order to further facilitate development of uniform flow. Weir plates 36 should be made of a refractory or heat-resistant material which is also resistant to corrosion by molten metal. Kaowool refractory board, treated with a diluted colloidal silica suspension has proven satisfactory. Weirs 36 may extend across the entire width or a portion of the width of casting vessel 18. As shown in FIG. 2, preferably, the molten metal level in the receiving end 22 of casting vessel 18 is at about the same level as the molten metal in exit end 26. Weirs 36 are useful for baffling or dampening the flow in order to facilitate development of a uniform fully-developed flow and to restrain movement of surface oxides and slag.

FIGS. **2*a* and 2*b* illustrate the use of surface tension of the flowing molten metal to form the surfaces of the strip being cast. FIG. 2*a* is a detailed elevation view in partial cross section of exit end 26 adjacent casting surface 20. Molten metal flowing from the exit end 26 forms and maintains a meniscus 35 between the inside surface of bottom wall 28 of the U-shaped structure and the casting surface. The surface tension forming meniscus 35 forms the bottom of the strip 15 being cast. The surface tension of the free surface of the molten metal pool in exit end 26 forms a curvilinear portion 39** on the top of the molten metal in the U-shaped structure as it forms the strip product.

FIG. 2*b* illustrates exit end 26 adjacent casting surface 20 showing solidifying metal 19 therebetween in a view from under exit end 26. The surface tension of the molten metal 19 forms the convex surfaces or meniscus 37 between exit end 26 and casting surface 20 at the inside surface 31 of sidewalls 30 near bottom wall 28.

Figure 4:
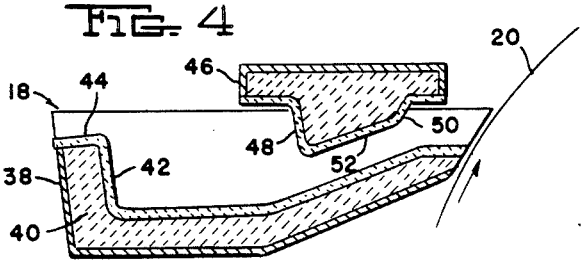
FIG. 4 is an elevation view in cross section of a preferred embodiment of a casting vessel of the present invention.
Figure 5:
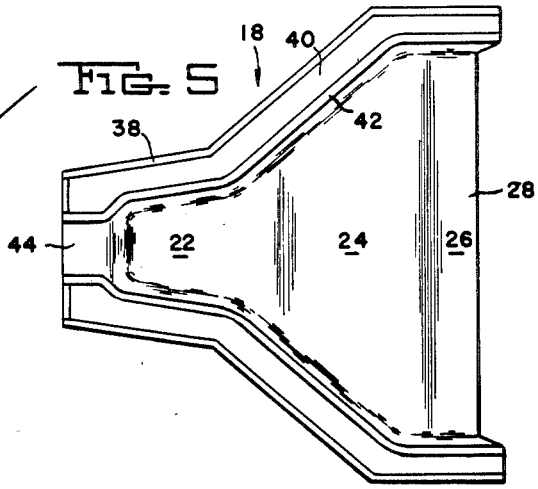
FIG. 5 is a top view of a preferred embodiment of the casting vessel of FIG. 4.

A preferred embodiment of casting vessel 18 is shown in the elevation and top views of FIGS. 4 and 5, respectively. Vessel 18 is shown having an outer metal support shell 38, a refractory insulation 40, and a liner 42 which defines the internal surface of the casting vessel 18 and which is in contact with molten metal during casting. The construction of vessel 18 should be made from refractory material which is heat insulative and resistant to molten metal corrosion. The casting vessel may be secured to some suitable table or means to orient and position the vessel at the desired casting position on the casting surface or wheel 20. The exit end 26 of casting vessel 18 should have the front face or edges 33 of sidewalls 30 and bottom wall 28 which define and form the U-shaped structure contoured to the casting surface. This can be done simply by using 60 or 100-grit silicon carbide grinding papers held between the casting surface and the vessel assembly and rubbing the paper against the vessel 18 to make the edges parallel to the wheel. The front surface 33 of the casting vessel 18 may then be brush coated with zirconia cement and allowed to dry before casting.

FIGS. 4 and 5 illustrate a preferred embodiment of the casting vessel 18 of the present invention which is useful for casting strips of 4 inches, and up to about 13 inches and may be useful up to 48 inches wide. The metal support shell 38 may be used depending upon the type of material used for the insulation layer 40. Insulation layer 40 may be a foamed ceramic cement insulation which would need an external support such as a metal support shell 38. In the alternative, if a standard refractory brick or block is used and cemented together into the desired shapes and then carved to achieve the desired inner and outer dimensions, then the outer shell 38 is not necessary. The vessel 18 may also be a monolithic shape formed from castable ceramic material. Liner 42 on the internal surface of casting vessel 18 is also made of an insulating refractory molten metal resistant material. It has been found that an insulating blanket of a high alumina fiber-silicate composition is useful, such as Fiberfrax brand material, that has been saturated in a diluted colloidal silica suspension and contoured within the casting vessel 18 and then dried prior to actual use.

FIGS. 4 and 5 also show a rear overflow element 44 including a rearwardly-sloping surface 45 extending from the inner surface of casting vessel 18 to the outer walls of vessel 18. The height of the overflow element 44 determines the maximum depth of molten metal that may be contained in the receiving end 2 and, accordingly, the depth of the molten metal in the exit end 26 of casting vessel 18. Overflow element 44 facilitates control of the molten metal level in the casting vessel 18 which is essential to gauge and quality control of the cast strip.

Also shown in FIG. 4 is a casting vessel 18 which may optionally include a cover assembly 46 in the vicinity of intermediate section 24 of casting vessel 18. Cover 46 includes downwardly-extending walls 48 and 50 joined by a bottom surface 52. The downwardly-extending walls 48 and 50 are similar to the weir plates shown in FIG. 2. Cover 46 is generally composed of a refractory insulative material resistant to molten metal. Cover 46 may comprise a liner 42, a refractory insulation layer 40 and an outer metal shell 38 having a similar manner of construction as is casting vessel 18. The cover 46 may extend across the entire width or part of the width of casting vessel 18 in the vicinity of intermediate section 24. It is important that the presence of a cover 46, which is useful for retaining the heat in the molten metal in the casting vessel 18, does not contact the molten metal in the receiving end 22 and exit end 26 in order to maintain the free surface in the pool in exit end 26. The cover also can extend over portions or all of rear receiving section 22 to contain a protective atmosphere therein.

Figure 6:
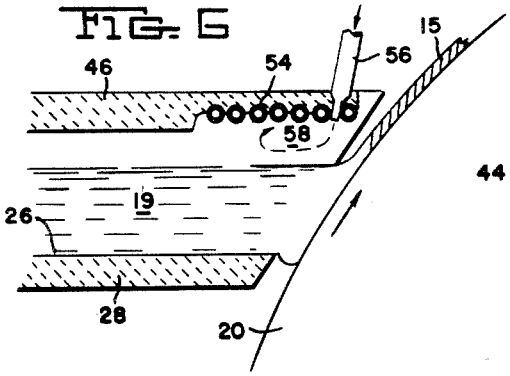
FIG. 6 is an enlarged elevated view of a preferred embodiment of the exit end of a casting vessel of the present invention.

FIG. 6 illustrates another embodiment wherein the exit end 26 of vessel 18 is provided with a means for providing a non-oxidizing atmosphere in a zone defined above the molten metal across the width of the U-shaped structure of exit end adjacent to casting surface 20 together with a means for radiantly cooling the molten metal in that zone. The two features may be present separately or in combination.

Means for providing a non-oxidizing atmosphere provides a protective cover or blanket of inert or reducing gases in a zone about the molten metal in the U-shaped structure of exit end 26. The gases minimize or prevent the buildup or formation of slag and oxides on the top surface of the molten metal, which oxide could be cast into the cast strip. The non-oxidizing atmosphere may be static, or a recirculating atmosphere. Preferably, a non-contacting cover over the zone above the molten metal pool at the exit end 26 of casting vessel 18 and at least one gas nozzle or a series of nozzles 56 provides a continuous flow of inert or reducing gas counter to the direction of the cast strip. Preferably the gas is introduced so that it impinges in the zone on the top of the molten metal liquid pool where the strip is emerging. The embodiment may provide a protective cover for sealing the zone over the molten metal pool containing a blanket of inert or reducing gases directed into streams of gases to push any oxide away from the forming of the strip. The series of narrow gas nozzles 56 is positioned along the width of the casting strip so that streams or jets of gas impact the zone wherein the strip emerges from the liquid pool. Nozzles 56 are directed counter to the casting of the strip at an angle to the plane of the formed strip, preferably about 20°–30°. The gas blanket may be a gas selected from the group consisting of hydrogen, argon, helium, and nitrogen in order to minimize the oxides that may be formed during casting. The velocity of the gases from nozzle 56 should be quite low, for higher velocities may cause a disturbance in the upper surface of the molten metal pool and result in damage to the cast strip.

Means for radiantly cooling the molten metal in the zone may include providing a coolant in the vicinity of the zone to facilitate extraction of heat from the top surface of the molten metal. The coolant may be provided by a panel of tubes or pipes 54 located above the molten liquid to remove radiated heat from the molten metal. Water or other fluid may be used as a coolant. Preferably, a cover is provided which includes a series of water-cooled tubes 54 sealed to the top of the casting vessel 18 with refractory material and cement. Radiant cooling of the top surface of molten metal as it flows from the U-shaped structure of exit end 26 onto casting surface improves the heat extraction from the top surface of the solidifying molten metal to improve as-cast strip top surface quality and structure by controlling the growth of dendritic structure in the strip.

Preferably, means for providing a non-oxidizing atmosphere and the means for radiantly cooling are used in combination. A non-contacting cover for sealing the zone over the molten metal at the exit end 26 includes a cooling means to remove radiated heat from the molten metal and a non-oxidizing atmosphere means. Preferably, the cover includes a series of water-cooled tubes 54 and a series of gas nozzles 56. The inert gases in this embodiment are cooled by the tubes 54 which further facilitate removal of the radiant heat. The cover containing the cooling tubes 54 seals the zone to reduce oxide or slag formation which could be deposited on the strip product.

In the operation of the casting apparatus of the present invention, vessel 12, tundish 14 and casting vessel 18 are preheated to operating temperatures prior to introducing molten metal into the casting vessel 18 for the production of strip material. Any conventional heating means should be suitable and may be used. An air-acetylene or air-natural gas heating lance positioned in the receiving end 22, as well as providing a preheat front cover for the front edges of the casting vessel U-shaped structure which will be placed adjacent the casting surface 20. Normal preheating temperatures for casting molten stainless steel may be on the order of 1900°-2000° F. After the minimum preheat levels desired are reached, the heating lances are removed and the vessel 18 is positioned adjacent the casting surface at a preset standoff distance such as between 5 and 20 mils.

In commencing the method of directly casting alloy from molten metal to continuous strip, molten metal 19 is supplied from a bulk transfer ladle or vessel 12 to a feed tundish 14 and thereafter to the casting vessel 18 which is oriented substantially horizontally. The flow of molten metal from feed tundish 14 to casting vessel 18 may be controlled and regulated by valve means such as stopper rod 16 and through spout 17 into the rear feed section or receiving end 22 of casting vessel 18. As vessel 18 begins to fill with molten metal, the molten metal begins to flow in a direction toward the exit end of the vessel and flows through an intermediate section 24 and the exit end 26 as shown in FIG. 2. Casting vessel 18 permits the molten metal to flow so as to feed the molten metal to the exit end 26 of vessel 18. Casting vessel 18 may include weirs 36 such as shown in FIG. 2 to dampen and baffle the flow of molten metal 19 in order to facilitate a uniform fully-developed flow in exit end 26. The molten metal preferably maintains a substantially uniform cross-sectional area of flow from the receiving end 22 through the exit end 26. Generally exit end 26 is wider than the receiving end 22 and the U-shaped structure has a width which approximates the width of the strip to be cast. Casting vessel 18 has a casting volume having tapered and fanned intermediate section. Casting vessel 18 is designed to prevent cross flows of molten metal within the vessel while developing a uniform turbulent flow from exit end 26 across the width of the U-shaped structure in end 26 such that the fully-developed flow has the bulk of the velocities in the direction of flow from the receiving end 22 to the exit end 26. The level of molten metal in exit end 26 is about the same as the level in receiving end 22, although the depth of the molten metal will be less in exit end 26. The molten metal continues to flow from the exit end 26 onto the moving casting surface 20 such that across the width of the U-shaped structure of exit end, a substantially uniform flow of molten metal is presented to the casting surface 20. The molten metal in exit end 26 has a top surface tension and the molten metal leaving the opening has edge surface tension which form, in part, the top and edges, respectively, of the cast strip 15. The bottom surface is formed from surface tension in the form of a meniscus between the bottom inside surface of the U-shaped structure and the casting surface.

Though there is no intent to be bound by theory, it appears that the solidification of the molten metal leaving the exit end of vessel 18 commences with the molten metal contacting the casting surface as it leaves the bottom of the U-shaped opening of exit end 26 of vessel 18. The strip is solidified from the pool of molten metal available to the casting surface at the exit end of vessel 18 and forms a thickness wherein the solidifying strip is continually presented with an oversupply of molten metal until leaving the exit end 26 of vessel 18. Such a pool of molten metal is believed to form a substantial part of the strip thickness as it contacts the moving casting surface 20 with only a minor portion of the strip thickness resulting from molten metal solidified as it was pulled out of the vessel 18 adjacent the top curvilinear surface tension portion 39. It is estimated that more than 70% and probably more than about 80% of the strip thickness results from the pool of molten metal provided adjacent the meniscus 35. The molten metal solidifies from the bottom of molten metal pool provided to the casting surface from the bottom of the U-shaped structure of exit end 26 of vessel 18.

Casting surface 20 moves past casting vessel 18 in a generally upward direction from the bottom of the U-shaped opening of of exit end 26 to the open top of the opening. The position of vessel 18 on the casting surface 20 and the speed of the casting surface are predetermined factors in order to achieve the quality and gauge of the cast strip. If the casting surface 20 is a casting wheel, then the vessel 18 is positioned, preferably, on an upper quadrant of the casting wheel.

By the method of the present invention, there is an important control of several factors which results in the ability to cast desired gauges of metal strip ranging from 0.01 to 0.06 inch with good surface quality and, edges and structure. The control of molten metal flow onto the casting surface, the speed of the casting surface, the solidification from the bottom of the molten metal pool, and the controlled depth of molten metal in the pool and standoff distance from the casting surface to maintain the surface tension of the molten metal are important interrelating factors.

In order to better understand the present invention, the following examples are presented.

EXAMPLE I

A casting vessel having the structure generally as shown in the FIG. 2 but having only one weir plate 36 near the exit end 26 was constructed from hardened blocks of Kaowool refractory, which is an alumina-silica composition material. It was treated by soaking it with a colloidal silica suspension dried overnight at 250° F. and then fired for 1 hour at 2000° F. in air. After the blocks were cut and shaped, they were coated with a thin layer of Kaowool cement. The vessel was shaped to the contour of the wheel and then the U-shaped structure ends were coated with a thin layer of a zirconia cement. A weir of similar composition was used. The casting vessel was then heated with air-acetylene lances. The vessel 18 was about 8.75 inches long from the receiving end 22 to the exit end 26 and was about 6.5 inches wide at the receiving end 22 and about 4 inches wide at bottom wall 28 at exit end 26. Molten metal of Type 304 alloy was tapped at 1580° C., supplied to the vessel 18 and maintained at a level of about 1.75 inches deep in the receiving end 22 and the molten metal was about 0.75 inches deep in the U-shaped structure in the exit end 26 of vessel 18. A casting surface was a copper casting wheel having a width of 7 inches and a diameter of about 36 inches which provided cooling on the order of less than 2000° C./sec. The casting wheel was rotated at a speed of about 250 to 300 feet per minute past the exit end of vessel 18 and spaced about 40 mils therefrom at an angle $\theta$ of about 40°. The U-shaped structure of the vessel had diverging or tapered inside surface 31 of sidewalls 30 of exit end 26 opening upwardly. The taper was on the order of about 3° per inside surface. Run 25 of about 100 pounds was cast according to the present invention and resulted in successful production of strip having a width of about 4 inches and a uniform thickness of from 16 to 18 mils having smooth and uniform upper and lower surfaces as-cast and flat edges showing no signs of raggedness or curls.

EXAMPLE II

A casting vessel having a structure generally as shown in FIG. 4 was constructed having a Kaowool refractory and alumina bubble refractory insulation 40 in a metal shell 38. The liner 42 was made of Fiberfrax material, 0.5 inch (1.27 cm) thick at eight pounds per cubic foot which was saturated with a diluted colloidal silica suspension and then dried prior to use. The vessel 18 outside dimensions were about 15 inches long and 18 inches wide at the exit end vessel 18 had a slight increasing cross-sectional area to exit end 26. Weir plate 36 was made and positioned similar to Example I and cemented between sidewalls of vessel 18. The inside surfaces 31 of sidewalls 30 were also tapered or diverging on the order of about 3° per surface. The casting vessel was set at a standoff distance of about 35 mils at an angle of about 0° for the free surface of the molten metal was near the crown of the casting wheel. A 500-pound Run 84-97 of molten metal of Type 304 was cast according to the present invention on a casting surface of a low carbon steel seamless pipe having a 12.75-inch outside diameter, a 0.375-inch wall thickness, 48 inches wide and internally spray water cooled. The casting wheel was rotated at about 200 FPM at the start of the casting for 10–15 seconds to facilitate flushing of the initial metal flow and then slowed to 100 FPM for the duration of the Run. The molten metal maintained a depth of about 2 inches (5.08 cm) in the exit end 26 and 2.75 inches (6.98 cm) in the receiving end 22.

The vessel 18 also included a cover having a means for radiantly cooling and means for providing a helium atmosphere as shown in FIG. 6. The cooling was effected by circulated water at about 3 gallons per minute through copper tubing having a 0.375-inch outside diameter.

The as-cast strip was about 13 inches wide, and having a uniform thickness of about 45 mils and having good upper surface quality which was uniform, smooth and crack free. The as-cast strip was then conventionally processed by pickling in a nitric/hydofluroic acid, cold rolling about 50% reduction, annealing at 1950° for 5 minutes, pickling again in a similar manner, and then cold rolling to 5 mils and annealed. The room temperature mechanical properties of the annealed as-cast samples are shown below in comparison to typical properties of conventionally produced Type 304 annealed hot-roll band.

TABLE

| Samples | Tensile Strength (KSI) | 0.2% Yield Strength (KSI) | Elongation in 2 inch. (%) |
|---|---|---|---|
| 1 | 104.6 | 44.6 | 52.0 |
| 2 | 100.8 | 40.8 | 50.0 |
| 3 | 100.8 | 40.8 | 49.0 |
| 4 | 100.0 | 40.0 | 52.5 |
| 7 | 102.8 | 42.0 | 55.0 |
| 8 | 102.0 | 42.0 | 57.5 |
| 9 | 103.6 | 44.0 | 52.0 |
| 10 | 105.2 | 44.0 | 54.5 |

Type 304 alloy conventionally produced may have typical or average room temperature mechanical properties of annealed hot-roll band of 101.1 KSI tensile strength, 43.8 KSI yield strength and 57% elongation in 2 inches.

Figure 7:
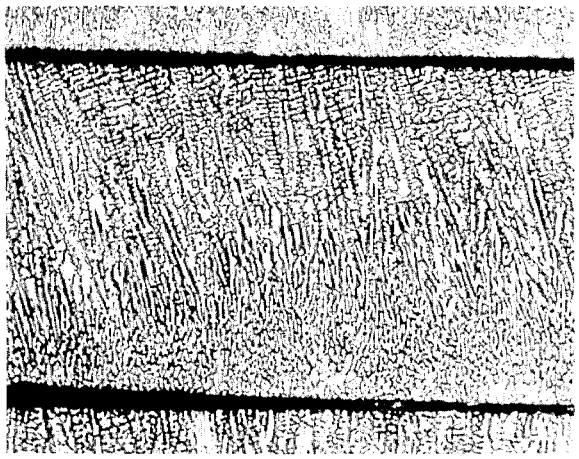
FIG. 7 is a photomicrograph of typical Type 304 alloy as-cast strip of the present invention.

FIG. 7 is a photomicrograph of as-cast strip of the present invention showing the typical internal structure from Run 84-52. The Type 304 alloy, shown at 100X magnification, illustrates the typical as-cast structure of small columnar cells oriented in the direction of strip thickness, i.e., top to bottom surfaces. This direction generally conforms to the direction of heat extraction from the strip as it solidifies. The method and apparatus of the present invention controls the growth of the dendritic structure in the strip to produce an as-cast strip which can be conventionally processed into finished strip having properties comparable to or better than conventionally produced strip product.

Figure 8:
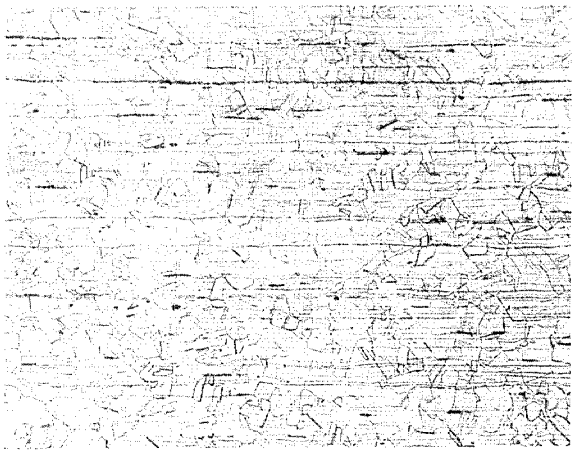
FIG. 8 is a photomicrograph of a typical Type 304 alloy conventionally produced hot-roll band.

FIG. 8 illustrates a typical structure of a conventionally produced hot-roll band of Type 304 alloy at 100X magnification.

It is observed that the method and apparatus of the present invention results in even better strip structure and quality as the gauge of the strip product increases and as the width of the strip increases. The tendency of edge curl in the strip product cast in 4 to 6-inch widths appears to no longer be present in the wider widths up to 13 inches. The method and apparatus of the present invention provides an uncomplicated and direct method for casting crystalline metal strip or sheet from molten metal to continuous strip. The shrinking and cracking problems of finite film solidification are eliminated and a relatively thick strip of quality comparable to or better than conventional production methods is provided.

The methods and apparatus appear useful for various metals and alloys, including stainless steels and silicon steels.

What is claimed is:

1. Method of directly casting molten metal to continuous strip of crystalline metal, comprising:

supplying molten metal to a receiving end of a casting vessel having a receiving end and an exit end, the exit end being adjacent to a casting surface and having edges thereof parallel to the casting surface and having a substantially uniform cross-sectional area over a length;

moving the cooling casting surface generally upwardly past the exit end;

feeding molten metal with a gradually increasing width of flow while maintaining a substantially uniform cross-sectional area or a slightly increasing cross-sectional area of flow from the receiving end to the exit end to provide a pool of molten metal having a substantially uniform flow and a free upper surface in the exit end of the casting vessel;

flowing molten metal from the exit end onto the moving casting surface with a substantially uniform flow across the width of the exit, the surface tension of the flowing metal forming all the surfaces of the strip to be cast, the surface tension of the free surface of the molten metal pool forming the top of the cast strip, the surface tension of the molten metal leaving the bottom of the exit end maintaining a meniscus between an inside surface of the bottom of the exit end and the casting surface to form the bottom of the cast strip; the surface tension of the molten metal leaving two sides of the exit end forming the edges of the cast strip and being about as wide as the strip being cast;

controlling the depth of molten metal in the exit end of the vessel and the distance between the exit end and the casting surface to maintain the surface tension of the molten metal on the top, bottom and sides; and removing cast strip from the moving casting surface.

2. The method of claim 1 wherein said feeding of molten metal in the casting vessel includes providing molten metal in the receiving end at the same level as in the exit end.

3. The method of claim 1 includes baffling the flow of molten metal in the casting vessel to facilitate development of uniform flow at the exit end.

4. The method of claim 1 includes moving the casting surface past a generally U-shaped structure of the exit end of the vessel in a direction generally from the bottom of the U-shaped structure to the top of the exit end.

5. The method of claim 1 wherein the direction of the upwardly moving casting surface at the exit end of the vessel is at an angle of from about 0° to 135° as measured from the horizontal in the direction of metal flow at the free surface.

6. The method of claim 5 wherein the angle is from 0° to 45° from the horizontal.

7. The method of claim 1 includes controlling the thickness of the strip by the speed of the casting surface and the depth of molten metal in the exit end of the casting vessel.

8. The method of claim 1 including cooling the molten after contact with the casting surface at a rate of less than 2000° C. per second to effect solidification of crystalline metal.

9. The method of claim 8 wherein the cooling is at a rate of less than 1500° C. per second.

10. The method of claim 1 wherein moving the casting surface is at a speed of 20 to 500 feet per minute.

11. The method of claim 1 wherein providing the casting surface parallel to edges of the exit end and at a distance of between 0.005 to 0.060 inches from the exit end.

12. The method of claim 1 wherein removing strip from the casting surface having a uniform strip width which ranges from 4 to 48 inches.

13. The method of claim 1 wherein removing strip having a uniform thickness which ranges from 0.010 to 0.100 inch.

14. Method of directly casting molten metal to continuous strip of crystalline metal, comprising:

supplying molten metal to a receiving end of a substantially horizontal casting vessel having a receiving end and an exit end, the exit end being adjacent to a casting surface and having a generally U-shaped structure and edges thereof parallel to the surface and spaced therefrom at a distance of between 0.005 to 0.060 inch and having a substantially uniform cross-sectional area over a length;

moving the casting surface generally upwardly past the exit end at a speed of 20 to 500 feet per minute in a path at an angle of 0° to 135° as measured between the free surface in the direction of metal flow and the direction of the casting surface at the exit end of the casting vessel;

feeding molten metal with a gradually increasing width of flow from the receiving end to the exit end while maintaining a substantially uniform cross-sectional area or a slightly increasing cross-sectional area of flow from the receiving end to the exit end to provide a pool of molten metal having a substantially uniform flow and free upper surface in the exit end;

flowing molten metal from the U-shaped structure of the exit end onto the moving casting surface with a substantially uniform across the width of the exit, the surface tension of the flowing metal forming the surfaces of the strip being cast, the surface tension of the free surface of the flowing molten metal forming the top of the cast strip, the surface tension of the molten metal leaving two sides of the exit end forming the edges of the cast strip and being about as wide as the strip being cast and the surface tension of the molten metal leaving the bottom of the U-shaped structure maintaining a meniscus between an inside surface of the bottom of the exit end and the casting surface to form thebottom of the cast strip;

cooling the molten metal upon contact with the casting surface at a rate of less than 2000° C. per second to effect solidification of crystalline metal;

controlling the depth of molten metal in the exit end of the vessel and the distance between the exit end and the casting surface to maintain the surface tension of the molten metal on the top, bottom and sides; and removing cast strip from the moving casting surface.

15. An apparatus for directly casting molten metal to continuous strip of crystalline material, comprising:

movable casting surface;

casting vessel having a receiving end, an exit end, and an intermediate section therebetween, said vessel having a cross-sectional area from receiving end to exit end being substantially uniform or slightly greater at the exit end;

means for supplying molten metal to the receiving end of the casting vessel;

said casting vessel having an exit end having a generally U-shaped structure adjacent the casting surface and edges thereof substantially parallel thereto, and an intermediate section having a gradually increasing width to the exit end to facilitate a substantially uniform flow of molten metal from the receiving end to the exit end, the U-shaped structure of the exit end having a planar bottom wall and diverging inside sidewalls opening upwardly and having a width between the inside surfaces about as wide as the strip to be cast, the exit end having fixed width along the bottom wall between the inside surfaces of the sidewalls and a substantially uniform cross-sectional area over a length sufficient to provide a substantially uniform flow of molten metal from the exit end;

said casting surface movable generally upwardly past the exit end of the casting vessel at a distance of between 0.005 to 0.060 inches therefrom and at a speed of 20 to 500 feet per minute.

16. The apparatus of claim 15 wherein the casting vessel includes a means for maintaining the molten metal level in the receiving end and exit end at the same level.

17. The apparatus of claim 15 wherein the intermediate section communicating between the receiving end and exit end has a gradually decreasing depth so as to maintain a substantially uniform cross-sectional area throughout the length of the casting vessel.

18. The apparatus of claim 15 including baffles in the casting vessel to faciliatate development of uniform flow.

19. The apparatus of claim 15 wherein the casting surface has a direction of movement upwardly at an angle of from about 0° to 135° from the horizontal in the direction of metal flow at the free surface.

20. The apparatus of claim 19 wherein the exit end of the vessel is adjacent a position on the casting wheel forming an angle of 0°–45°.

21. The apparatus of claim 15 wherein the casting surface comprises the peripheral surface of a rotating casting wheel.

22. The apparatus of claim 21 wherein the exit end of the casting vessel is adjacent a position in an upper quadrant of the casting wheel.

23. An apparatus for directly casting molten metal to continuous strip of crystalline material. comprising:

movable casting surface;

substantially horizontal casting vessel;

means for supplying molten metal to the casting vessel;

said casting vessel having a receiving end, an exit end having a generally U-shaped structure adjacent the casting surface and substantailly parallel thereto, and an intermediate section communicating between the receiving end and the exit end, the intermediate section having a gradually increasing width to the exit end and a gradually decreasing depth to the exit end so as to maintain a substantially uniform cross-sectional area or a slightly greater cross-sectional area from the receiving end to the exit of the vessel, the exit end having a bottom wall and diverging sidewalls opening upwardly defining the U-shaped structure having a width between the inside surfaces of the sidewalls being about as wide as the strip to be cast, the width of the bottom wall between the inside surface of the sidewalls being fixed to provide a substantially uniform cross-sectional area over a length at least equal to the depth of the metal therein, the length being sufficient to provide a substantially uniform flow of molten metal from the exit, said casting surface movable generally upwardly past the exit end of the casting vessel at a distance of between 0.005 to 0.060 inches therefrom and said surface having an upward path forming an angle of 0° to 135° between the direction of metal flow at the free surface and the direction of casting surface movment at the free surface, the casting surface moving at a speed of 20 to 50 feet per minute.

24. A continuous strip of crystalline metal made in accordance with the method of claim 1, the strip having the two surfaces thereof being uniform and smooth and having an internal structure of relatively small columnar cells oriented in the direction from one surface to the other surface.

25. The continuous strip of claim 24 having a uniform as-cast thickness of 0.010 to 0.100 inch.

26. The continuous strip of claim 24 having edges which are substantially flat and smooth.

27. The continuous strip of claim 24 which when subsequently pickled, annealed, cold rolled with an intermediate anneal to a final gauge of 0.002 to 0.040 inch and then annealed in a conventional manner, exhibits mechanical properties comparable to or better than conventionally produced strip product.

28. A continuous strip of crystalline metal directly cast from molten metal having a substantially uniform flow and free upper surface onto a single moving casting surface wherein the molten metal flows from a vessel which has a receiving end and an exit end with a gradually increasing width of flow while maintaining a substantially uniform cross-sectional area or a slightly increasing cross-sectional area from the receiving end to the exit end and substantially uniform cross-sectional area of flow over a length at the exit end, the strip comprising an upper surface and a lower surface which contacted the casting surface, both the upper and lower surfaces in the as-cast condition being smooth and uniform, edges of the strip being substantially flat and smooth, the as-cast thickness ranging from 0.010 to 0.100 inch, and the internal structure having relatively small cclumnar cells oriented in the direction from one strip surface to the other strip surface.

29. The strip of claim 28, which when pickled, annealed, cold rolled with an intermediate anneal to final gauge of 0.002 to 0.040 inch and then annealed, exhibits mechanical properties at least comparable to conventionally produced strip product.

* * * * *